US007673959B2

(12) United States Patent
Maru et al.

(10) Patent No.: US 7,673,959 B2
(45) Date of Patent: Mar. 9, 2010

(54) INKJET PRINTING APPARATUS, METHOD FOR SETTING RECOVERY OPERATION IN INKJET PRINTING APPARATUS, AND INK TANK

(75) Inventors: Akiko Maru, Kawasaki (JP); Kiichiro Takahashi, Yokohama (JP); Minoru Teshigawara, Yokohama (JP); Tetsuya Edamura, Kawasaki (JP); Yoshiaki Murayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 397 days.

(21) Appl. No.: 11/480,885

(22) Filed: Jul. 6, 2006

(65) Prior Publication Data

US 2007/0008368 A1 Jan. 11, 2007

(30) Foreign Application Priority Data

Jul. 8, 2005 (JP) ..... 2005-200651

(51) Int. Cl.
*B41J 29/393* (2006.01)

(52) U.S. Cl. ..... 347/19

(58) Field of Classification Search ..... 347/30
See application file for complete search history.

(56) References Cited

U.S. PATENT DOCUMENTS 5,434,603 A * 7/1995 Hunt ..... 347/7
5,900,889 A * 5/1999 Tsukuda ..... 347/23
6,318,834 B1 * 11/2001 Otsuka et al. ..... 347/23
6,994,416 B2 2/2006 Seki et al.
7,011,386 B2 3/2006 Iwasaki et al.
2004/0130582 A1 * 7/2004 Hanaoka et al. ..... 347/6
2004/0145635 A1 * 7/2004 Ebisawa et al. ..... 347/85
2005/0083365 A1 * 4/2005 Numata et al. ..... 347/19
2005/0110823 A1 * 5/2005 Kobayashi et al. ..... 347/19

FOREIGN PATENT DOCUMENTS

JP 2000-127448 5/1996

* cited by examiner

*Primary Examiner*—Stephen D Meier
*Assistant Examiner*—Alexander C Witkowski
(74) *Attorney, Agent, or Firm*—Fitzpatrick, Cella, Harper & Scinto

(57) ABSTRACT

There is provided an inkjet printing apparatus which executes a proper recovery operation in accordance with the demounting time period of an ink tank and information of the ink tank. In the inkjet printing apparatus of this invention, the demounting time period and information of the ink tank are used as parameters for determining the condition of a recovery operation after the ink tank is once demounted and thereafter mounted again. Since recovery is done in consideration of the degrees of ink evaporation and an increase in viscosity, wasteful ink consumption can be suppressed while a necessary recovery operation is performed.

4 Claims, 10 Drawing Sheets

FIG. 5

| DEMOUNTING TIME PERIOD t [SEC] OF INK TANK | RECOVERY OPERATION |
|---|---|
| $t = 0$ | NOTHING IS DONE. |
| $0 < t \leqq X$ | DISCHARGE IS PERFORMED 20 TIMES PER NOZZLE FROM NOZZLES TO WHICH INK OF MOUNTED INK TANK IS SUPPLIED. |
| $X < t \leqq Y$ | RECOVERY SEQUENCE INCLUDING SUCTION OF 0.2-g INK AT SUCTION PUMP SPEED OF 500 SLITS/SEC |
| $Y < t$ | RECOVERY SEQUENCE INCLUDING SUCTION OF 0.2-g INK AT SUCTION PUMP SPEED OF 1,000 SLITS/SEC |

FIG. 6A

| DEMOUNTING TIME PERIOD t [SEC] OF C/M/Y/K INK TANKS | RECOVERY OPERATION |
|---|---|
| $t \leqq 60$ | NOTHING IS DONE. |
| $60 < t$ | CLEANING OPERATION (I) IS DONE. |

FIG. 6B

| DEMOUNTING TIME PERIOD t [SEC] OF Bk PIGMENT INK TANK | RECOVERY OPERATION |
|---|---|
| $t \leqq 10$ | NOTHING IS DONE. |
| $10 < t$ | CLEANING OPERATION (II) IS DONE. |

FIG. 7A

| DEMOUNTING TIME PERIOD t [SEC] OF C/M/Y/K INK TANKS | RECOVERY OPERATION |
|---|---|
| $t \leqq 60$ | NOTHING IS DONE. |
| $60 < t$ | CLEANING OPERATION (I) IS DONE. |

FIG. 7B

| DEMOUNTING TIME PERIOD t [SEC] OF Bk PIGMENT INK TANK | RECOVERY OPERATION |
|---|---|
| $t = 0$ | NOTHING IS DONE. |
| $0 < t$ | CLEANING OPERATION (II) IS DONE. |

FIG. 8A

| DEMOUNTING TIME PERIOD t [SEC] OF INK TANK | RECOVERY OPERATION |
|---|---|
| $t = 0$ | NOTHING IS DONE. |
| $0 < t$ | CLEANING OPERATION IS DONE. |

FIG. 8B

| DEMOUNTING TIME PERIOD t [SEC] OF INK TANK | RECOVERY OPERATION |
|---|---|
| $t \leqq 60$ | NOTHING IS DONE. |
| $60 < t$ | CLEANING OPERATION IS DONE. |

FIG. 9A

| DEMOUNTING TIME PERIOD t [SEC] OF INK TANK | RECOVERY OPERATION |
|---|---|
| $t \leqq 10$ | NOTHING IS DONE. |
| $10 < t$ | CLEANING OPERATION IS DONE. |

FIG. 9B

| DEMOUNTING TIME PERIOD t [SEC] OF INK TANK | RECOVERY OPERATION |
|---|---|
| $t \leqq 60$ | NOTHING IS DONE. |
| $60 < t$ | CLEANING OPERATION IS DONE. |

INKJET PRINTING APPARATUS, METHOD FOR SETTING RECOVERY OPERATION IN INKJET PRINTING APPARATUS, AND INK TANK

FIELD OF THE INVENTION

The present invention relates to an inkjet printing apparatus, a method for setting a recovery operation in the inkjet printing apparatus, and an ink tank and, more particularly, to a recovery operation executed after an ink tank is mounted in an inkjet printing apparatus.

BACKGROUND OF THE INVENTION

Some printing apparatuses are configured to print an image of a dot pattern on a printing medium such as paper or a thin plastic plate on the basis of image information. Of these printing apparatuses, an inkjet printing apparatus discharges ink (printing solution) as a printing agent from the discharge apertures of a printhead, and attaches the ink to the printing medium to print.

In the inkjet printing apparatus which treats liquid ink as a printing agent, ink evaporates if the connecting portion between the ink tank and the printhead is not properly sealed. In a state (demounting state) in which an ink tank which has been mounted on the printhead is demounted from the printhead, ink evaporation from the connecting portion tends to proceed, and ink may stick within the ink flow path. If the demounting state of the ink tank continues for a long time, bubbles may enter the ink flow path in the printhead. Ink evaporation and entry of bubbles become more serious as the ink tank demounting time becomes longer.

If the ink flow path is not filled with ink owing to ink evaporation and entry of bubbles, bubbles flow into nozzles serving as ink discharge portions of the printhead, and the printhead fails to discharge ink (non-discharge state). Since no sufficient amount of ink flows in the above case, the size of ink droplets becomes smaller than that when the ink flow path is normally filled with ink. As a result, ink droplets may land at points different from desired landing points on a printing medium, or no fine dot shape can be obtained on a printing medium. Further, once sticking occurs in the ink flow path upon ink evaporation, the ink flow is obstructed at the portion of fixation, and ink supply becomes late. In the worst case, ink clogs nozzles or flow paths.

In this manner, degradation of the image quality or a failure in printing itself may occur due to mounting/demounting of the ink tank.

In order to solve these problems, a conventional printing apparatus generally executes a recovery operation upon newly mounting an ink tank. The recovery operation is performed to remove bubbles from the ink flow path, wipe clogging, and remove paper dust and another dust. More specifically, the recovery operation executes a sucking operation to suck ink from a nozzle while tightly closing the nozzle (discharge aperture) portion of the printhead with a cap, a preliminary discharge operation to discharge ink irrespective of printing, or a wiping operation to clean the nozzle surface of the printhead. These operations are combined in accordance with conditions to control the printing apparatus so as to keep the printhead optimal.

If, however, a sufficient recovery operation is executed every time when the ink tank is mounted, an ink amount consumed by the recovery operation increases, and the running cost increases.

In order to solve these problems, according to Japanese Patent Laid-Open No. 2000-127448, the demounting time period of an ink tank is detected, and an ink amount to be sucked by a recovery operation is set on the basis of the demounting time period. More specifically, as the demounting time period of the ink tank is longer, the ink suction amount is set larger.

SUMMARY OF THE INVENTION

Some inkjet printing apparatuses are equipped with a plurality of ink tanks in accordance with ink types for use. In an apparatus of this type, ink tanks may have different ink capacities, different lengths or shapes of the ink flow path to the discharge aperture of the printhead, or different numbers of nozzles. In this case, an ink amount (recovery amount) necessary for a recovery operation is determined not only by the demounting time period of the ink tank. It is not satisfactory to determine the ink suction amount in consideration of only the demounting time period of the ink tank.

Depending on the type and composition of ink in the ink tank, the degrees of evaporation, coagulation, precipitation, and the like change more or less. For this reason, a minimum ink amount necessary for a recovery operation is different between ink tanks which store different types of inks. If the same recovery condition is set for all ink tanks, the recovery operation is not minimum.

In addition, when the remaining ink amount of the ink tank before demounting is small and the ink tank is to be exchanged with a new unused one, the density difference of ink may change depending on the preservation state. In this case, if a recovery condition is set on the basis of only the demounting time period in exchange, no satisfactory recovery operation can be executed.

The present invention has been made in consideration of the above situation, and has as its object to enable executing a proper recovery operation in accordance with the demounting time period of the ink tank and information of the ink tank.

As one aspect of the present invention which achieves the above object, an inkjet printing apparatus which performs printing using a printhead for discharging ink, and an ink tank supplying ink to the printhead, the ink tank being demountable from the printhead, comprises a recovery unit adapted to execute a recovery operation for maintaining a discharge state of the printhead, a measurement unit adapted to measure a demounting time period which continues a demounting state when the ink tank is demounted from the printhead to be the demounting state, an acquisition unit adapted to acquire information of the ink tank which is in the demounting state, and a determination unit adapted to determine a condition of the recovery operation executed by the recovery mechanism, in accordance with at least the demounting time period and the information of the ink tank.

With this configuration, when a demounted ink tank is again mounted, a recovery condition is determined in accordance with at least the demounting time period of the ink tank and information of the ink tank.

The present invention can perform an appropriate recovery operation corresponding to the degrees of ink evaporation and an increase in viscosity which occur depending on the length of the demounting time period, the ink type, and the like. Consequently, a discharge failure and degradation of the printing image quality can be reduced, and wasteful ink consumption can be suppressed.

As another aspect of the present invention which achieves the above object, a method for determining a condition of a recovery operation in an inkjet printing apparatus which performs printing using a printhead that discharges ink, and an ink tank that is demountable from the printhead and supplies ink to the printhead comprises steps of measuring a demounting time period which continues a demounting state when the ink tank is demounted from the printhead to be the demounting state, acquiring information of the ink tank which is in the demounting state, and determining a condition of the recovery operation executed for the printhead, in accordance with at least the demounting time period and the information of the ink tank.

As still another aspect of the present invention which achieves the above object, there is provided an ink tank for supplying ink to a printhead, the ink tank being demountable from the printhead used in an inkjet printing apparatus, wherein the inkjet printing apparatus comprises a unit to execute a recovery operation for maintaining a discharge state of the printhead, a unit to measure a demounting time period which continues a demounting state when the ink tank is demounted from the printhead to be the demounting state, a unit to acquire, from the ink tank, information of the ink tank which is in the demounting state, and a unit to determine a condition of the recovery operation executed for the printhead, in accordance with the demounting time period and the information of the ink tank, and the ink tank comprises a memory which stores the information of the ink tank.

Note that the above objects can also be achieved by a computer program which causes a computer apparatus to execute the method for setting a recovery operation in the inkjet printing apparatus, and a storage medium which stores the program.

According to the present invention, when a demounted ink tank is again mounted, a recovery condition is determined in accordance with at least the demounting time period of the ink tank and information of the ink tank.

The present invention can, therefore, achieve an appropriate recovery operation considering the degrees of ink evaporation and an increase in viscosity. As a result, a discharge failure and degradation of the printing image quality can be reduced, and wasteful ink consumption can be suppressed.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 5 is a table showing the correspondence between the demounting time period and the recovery operation in the first embodiment;

FIGS. 6A and 6B are tables showing the correspondence between the demounting time period and the recovery operation in the second embodiment;

FIGS. 7A and 7B are tables showing the correspondence between the demounting time period and the recovery operation in the third embodiment;

FIGS. 8A and 8B are tables showing the correspondence between the demounting time period and the recovery operation in the fourth embodiment;

FIGS. 9A and 9B are tables showing the correspondence between the demounting time period and the recovery operation in the sixth embodiment.

DETAILED DESCRIPTION OF THE PREFERRED EMBODIMENTS

Preferred embodiments of the present invention will be illustratively described in detail below with reference to the accompanying drawings. However, components described in the following embodiments are merely an example, and are not construed to limit the scope of the present invention to only themselves.

In this specification, "printing" (to be also referred to as "print") means not only forming significant information such as a character or figure, but should be widely interpreted. More specifically, "printing" means forming an image, design, pattern, or the like on a printing medium or processing a medium regardless of whether information is significant or insignificant, or whether information is so visualized as to allow the user to visually perceive it.

"Printing medium" are not only paper used in a general printing apparatus, but also ink-receivable materials such as cloth, a plastic film, a metal plate, glass, ceramics, wood, and leather in a broad sense.

"Ink" and "liquid" should be interpreted as widely as the definition of "printing (print)". More specifically, "ink" and "liquid" represent a liquid which is applied to a printing medium to form an image, design, pattern, or the like, process the printing medium, or contribute to ink processing (e.g., solidification or insolubilization of a coloring material in ink applied to a printing medium).

Figure 1:
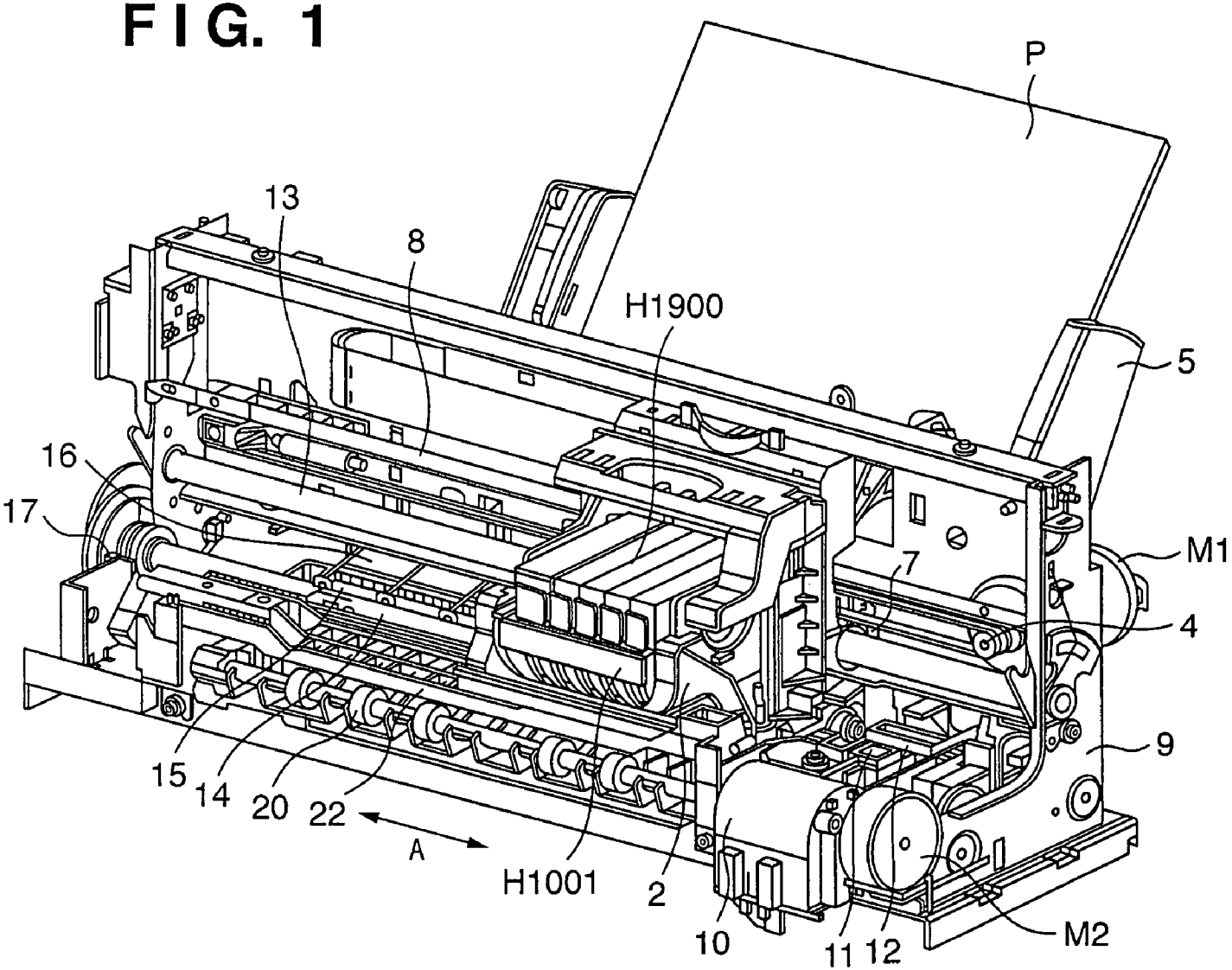
FIG. 1 is a perspective view showing the schematic structure of an inkjet printing apparatus as a typical embodiment of the present invention.

<Description of Inkjet Printing Apparatus in FIG. 1>

FIG. 1 is a perspective view showing the schematic structure of an inkjet printing apparatus as a typical embodiment of the present invention, wherein a cover is removed.

As shown in FIG. 1, in the inkjet printing apparatus (to be referred to as a printing-apparatus hereinafter), a carriage 2 supports a printhead H1001 for discharging ink to print by the inkjet method. A transfer mechanism 4 transfers a driving force generated by a carriage motor M1 to scan the carriage 2 in a direction indicated by an arrow A. At the same time, a printing medium P such as printing paper is supplied via a sheet supply mechanism 5, and fed to a printing position. At the printing position, the printhead H1001 discharges ink to the printing medium P to print.

In order to maintain the printhead H1001 in a good condition, the carriage 2 is moved to the position of a recovery apparatus 10, and a recovery operation for the printhead H1001 is executed intermittently. In this case, the recovery operation (also called a "cleaning operation") is to remove bubbles from the ink flow path of the printhead H1001, wipe clogging, and remove paper dust and another dust. More specifically, the recovery operation executes a sucking operation to suck ink from a nozzle while tightly closing the nozzle (discharge aperture) portion of the printhead with a cap, a preliminary discharge operation to discharge ink irrespective of printing, or a wiping operation to clean the nozzle surface of the printhead. These operations are combined in accordance with conditions to control the printing apparatus so as to keep the printhead in a good condition.

The carriage 2 of the printing apparatus 1 supports not only the printhead H1001, but also an ink tank H1900 which stores ink to be supplied to the printhead H1001. The ink tank H1900 is demountable from the printhead.

The carriage 2 and printhead H1001 can achieve and maintain a desired electrical connection by properly bringing their contact surfaces into contact with each other. The printhead H1001 selectively discharges ink from a plurality of discharge apertures and prints by applying energy in accordance with the printing signal. In particular, the printhead H1001 according to the embodiment adopts an inkjet method of discharging ink by using thermal energy. More specifically, electric energy applied to an electric-to-thermal transducer is converted into thermal energy. Ink is discharged from discharge apertures by using a pressure change caused by the growth and contraction of bubbles by film boiling caused by applying the thermal energy to ink. The electric-to-thermal transducer is arranged in correspondence with each discharge aperture, and ink is discharged from a corresponding discharge aperture by applying a pulse voltage to a corresponding electric-to-thermal transducer in accordance with the printing signal.

As shown in FIG. 1, the carriage 2 is coupled to part of a driving belt 7 of the transfer mechanism 4 which transfers the driving force of the carriage motor M1. The carriage 2 is slidably guided and supported along a guide shaft 13 in the direction indicated by the arrow A. The carriage 2 scans back and forth along the guide shaft 13 by normal rotation and reverse rotation of the carriage motor M1. A scale 8 which represents the absolute position of the carriage 2 is arranged along the moving direction (direction indicated by the arrow A) of the carriage 2 in order to indicate the position of the carriage 2. In the embodiment, the scale 8 is prepared by printing black bars on a transparent PET film at a necessary pitch. One end of the scale 8 is fixed to a chassis 9, and the other end is supported by a leaf spring (not shown).

The printing apparatus 1 has a platen (not shown) opposing the discharge aperture surface having the discharge apertures (not shown) of the printhead H1001. When the carriage 2 supporting the printhead H1001 scans by the driving force of the carriage motor M1, a printing signal is simultaneously supplied to the printhead H1001 to discharge ink and print on the entire width of the printing medium P fed onto the platen.

In FIG. 1, reference numeral 14 denotes a feed roller which is driven by a sheet feed motor M2 in order to feed the printing medium P, 15 is a pinch roller which makes the printing medium P abut against the feed roller 14 by a spring (not shown), 16 is a pinch roller holder which rotatably supports the pinch roller 15, and 17 is a feed roller gear which is fixed to one end of the feed roller 14. The feed roller 14 is driven by rotation of the sheet feed motor M2 that is transferred to the feed roller gear 17 via an intermediate gear (not shown).

Reference numeral 20 denotes a discharge roller for discharging the printing medium P bearing an image formed by the printhead H1001 outside the printing apparatus. The discharge roller 20 is driven by transferring the rotation of the sheet feed motor M2. The discharge roller 20 abuts against a spur roller (not shown) which presses the printing medium P by a spring (not shown). Reference numeral 22 denotes a spurholder which rotatably supports the spur roller.

As shown in FIG. 1, in the printing apparatus, the recovery apparatus 10 which performs a recovery operation for the printhead H1001 is arranged at a desired position outside the scanning range for the printing operation of the carriage 2 supporting the printhead H1001. In the present embodiment, the recovery apparatus 10 is arranged at a position corresponding to the home position.

The recovery apparatus 10 comprises a capping mechanism 11 which caps the discharge aperture surface of the printhead H1001, and a wiping mechanism 12 which cleans the discharge aperture surface of the printhead H1001. The recovery apparatus 10 forcibly discharges ink from discharge apertures by suction means (suction pump or the like) provided in the recovery apparatus 10 in synchronism with the capping of the discharge aperture surface by the capping mechanism 11. This operation achieves a recovery operation to, for example, remove ink with a high viscosity or bubbles in the ink flow path of the printhead H1001.

In a non-printing operation or the like, the discharge aperture surface of the printhead H1001 is capped by the capping mechanism 11 to protect the printhead H1001 and prevent evaporation and drying of ink. The wiping mechanism 12 is arranged near the capping mechanism 11, and wipes ink droplets attached to the discharge aperture surface of the printhead H1001.

The capping mechanism 11 and wiping mechanism 12 can maintain the printhead H1001 in a normal ink discharge condition. Note that the recovery operation is not limited to the above-mentioned sucking operation and wiping operation, and may be a preliminary discharge operation to preliminarily discharge ink to a capping mechanism or an ink reservoir-specific portion.

Figure 2:
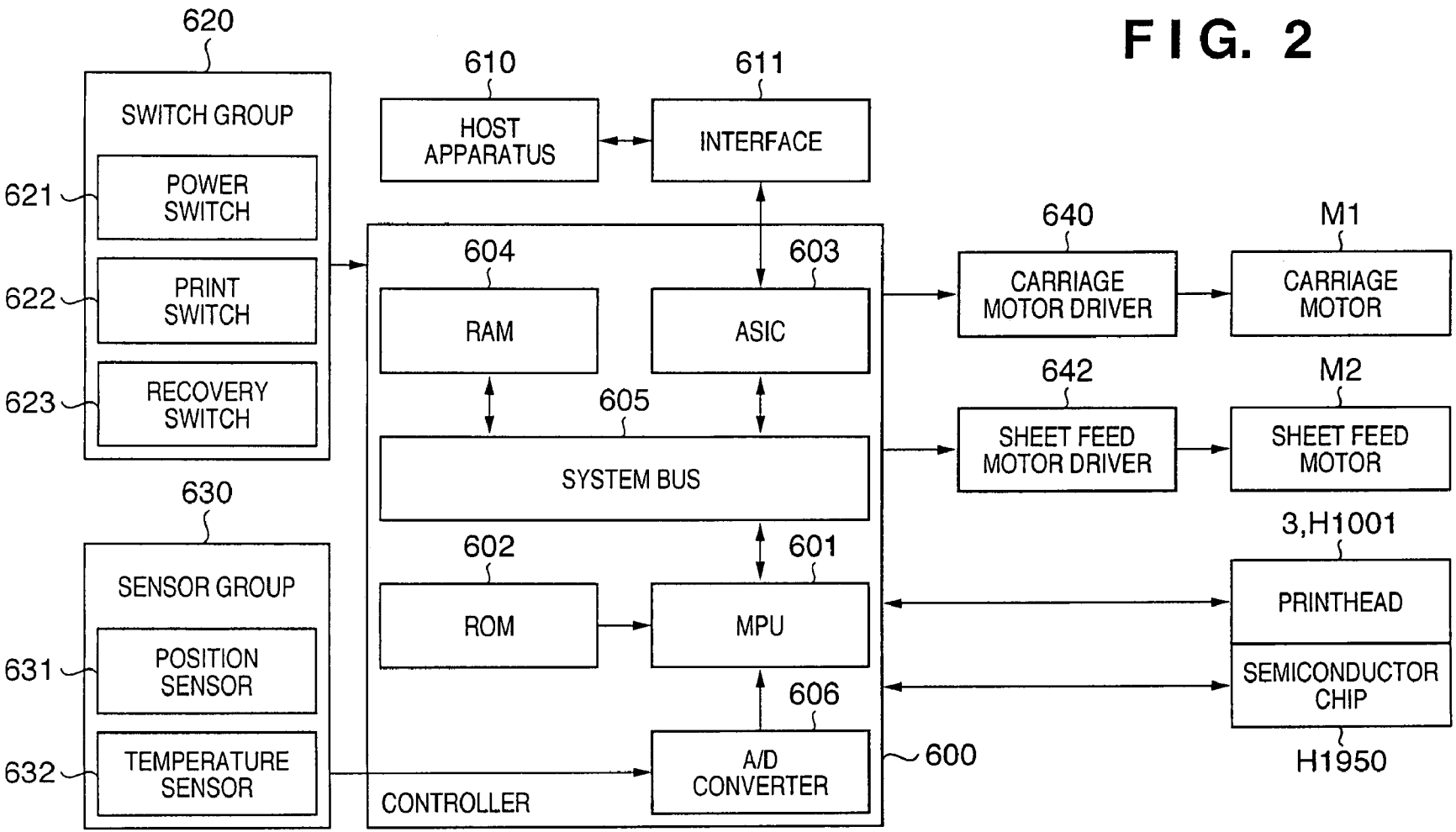
FIG. 2 is a block diagram showing the configuration of the control circuit of the printing apparatus in FIG. 1.

<Control Configuration of Inkjet Printing Apparatus in FIG. 2>

FIG. 2 is a block diagram showing the control configuration of the printing apparatus shown in FIG. 1.

As shown in FIG. 2, a controller 600 comprises an MPU 601, and a ROM 602 which stores a program corresponding to a control sequence (to be described later), a predetermined table, and other permanent data. The controller 600 also comprises an ASIC (Application Specific Integrated Circuit) 603 which generates control signals for controlling the carriage motor M1, sheet feed motor M2, and printhead 3. The controller 600 further comprises a RAM 604 having an image data rasterizing area, a work area for executing a program, and the like. The MPU 601, ROM 602, ASIC 603, and RAM 604 are connected to each other by a system bus 605, and exchange data. In addition, the controller 600 comprises an A/D converter 606 which receives analog signals from a sensor group 630 (to be described below), converts the received analog signals to digital signals, and supplies the digital signals to the MPU 601.

In FIG. 2, reference numeral 610 denotes a computer (or an image reader, digital camera, or the like) which serves as an image data supply source and is generally referred to as a host apparatus. The host apparatus 610 and printing apparatus 1 transmit and/or receive image data, commands, status signals, and the like via an interface (I/F) 611.

Reference numeral 620 denotes a switch group which is formed from switches for receiving instruction inputs from the operator. The switch group 620 includes a power switch 621, a print switch 622 for designating the start of printing, and a recovery switch 623 for designating the activation of a recovery operation to maintain good ink discharge performance of the printhead H1001. The sensor group 630 detects the state of the apparatus, and includes a position sensor 631 such as a photocoupler for detecting a home, position and a temperature sensor 632 arranged at a proper portion of the printing apparatus in order to detect the ambient temperature.

Reference numeral 640 denotes a carriage motor driver which drives the carriage motor M1 for scanning the carriage 2 in the direction indicated by the arrow A; and 642, a sheet feed motor driver which drives the sheet feed motor M2 for feeding the printing medium P.

In printing and scanning by the printhead H1001, the ASIC 603 transfers driving data (printing data) for a printing element (discharge heater) to the printhead while directly accessing the memory area of the ROM 602.

<Printhead Cartridge>

Figure 3:
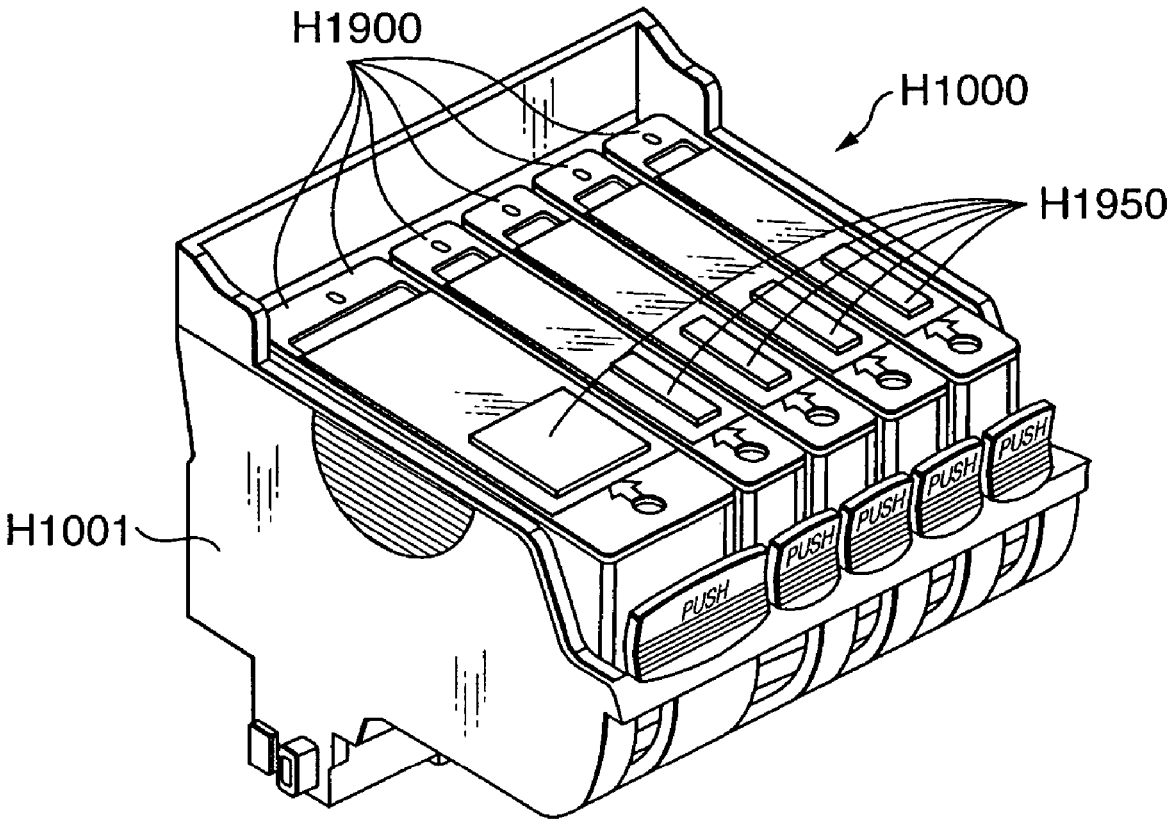
FIG. 3 is a perspective view showing a printhead cartridge used in the inkjet printing apparatus in FIG. 1.

The printhead H1001 in the embodiment adopts a so-called cartridge form in which the printhead H1001 is demountably mounted on the carriage 2. As shown in FIG. 3, a printhead cartridge H1000 is made up of a plurality of ink tanks H1900 which store ink, and the printhead H1001 which discharges ink supplied from the ink tanks H1900 from nozzles in accordance with printing information.

Figure 4:
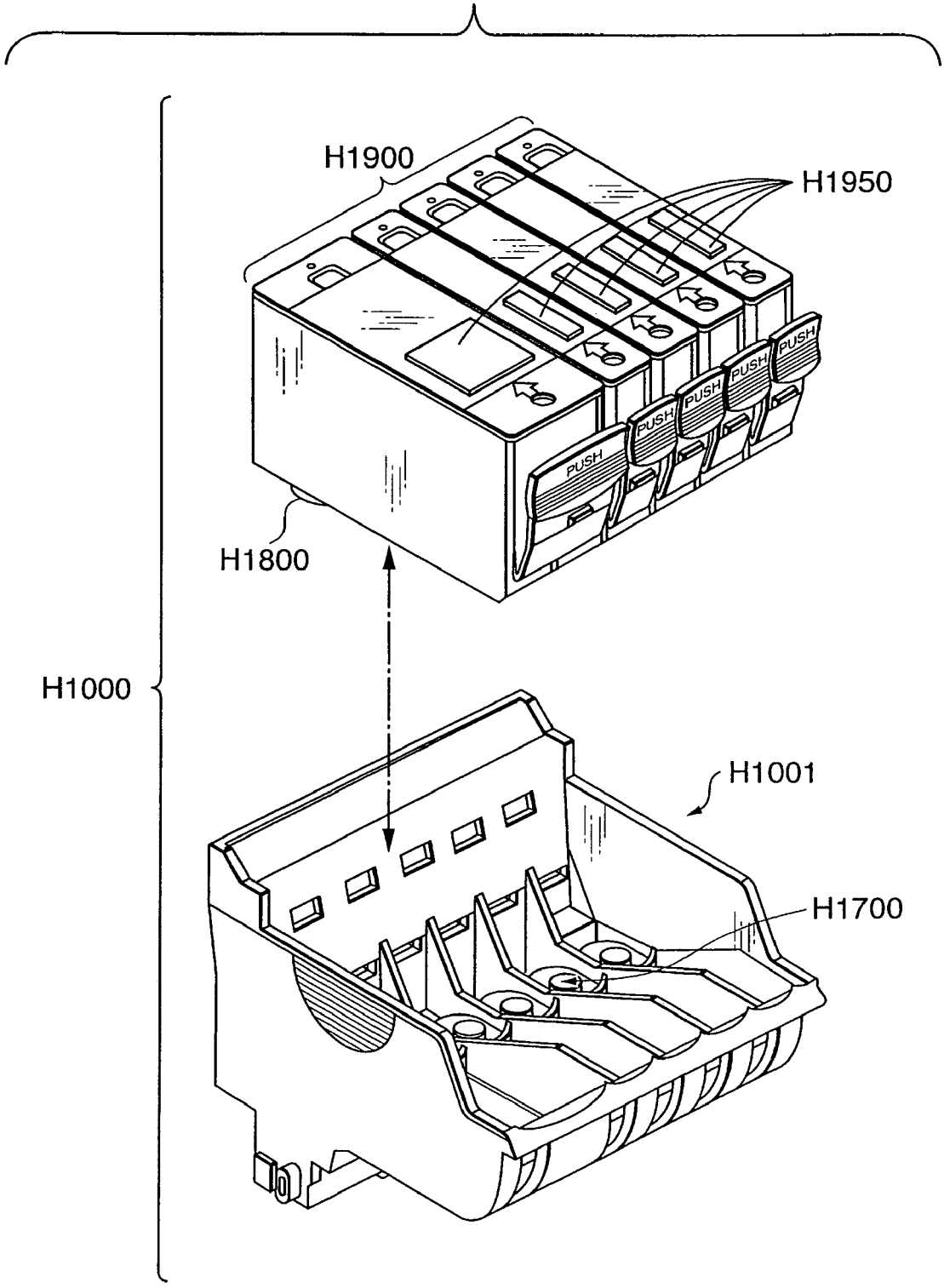
FIG. 4 is an exploded perspective view showing the head cartridge in FIG. 3.

The printing apparatus in the present embodiment can perform color printing. For this purpose, the printhead H1001 is equipped with five ink tanks H1900 which store dye inks of magenta (M), cyan (C), yellow (Y), and black (K), and black pigment ink, respectively. As shown in FIG. 4, these five ink tanks are independently demountable from the printhead H1001. In this manner, the embodiment uses a plurality of inks in different colors, and also uses a plurality of inks with different compositions.

Each ink tank H1900 has a snap mechanism, fitting mechanism, or the like. The ink tank H1900 is pushed from above the printhead H1001, their corresponding portions engage with each other, and the ink tank H1900 is fixed to the printhead H1001. A sealing portion H1800 functioning as an ink supply path is arranged at a-lower portion of the ink tank H1900, and a sealing rubber H1700 containing a filter is arranged at a corresponding portion of the printhead H1001. When the ink tank is mounted, the sealing portion H1800 and sealing rubber H1700 tightly contact each other to supply ink from the ink tank H1900 to the printhead H1001. The sealing portion H1800 and sealing rubber H1700 correspond to a connecting portion at which the ink tank H1900 and printhead H1001 are connected to each other.

As shown in FIGS. 3 and 4, each ink tank H1900 comprises a semiconductor chip (memory) H1950 which electrically stores, e.g., ID information for identifying the type of ink tank (ink type) and each ink tank, and an electrical contact (not shown) for reading out/writing information from/in the semiconductor chip H1950. Information which is stored in advance in the semiconductor chip H1950 is only readably stored. Information such as the amount of ink used can be written in a predetermined area of the semiconductor chip H1950.

The printhead H1001 also has an electrical contact (not shown) which, when each ink tank H1900 is mounted, contacts the electrical contact of the ink tank, reads out information from the semiconductor chip H1950, and writes information in the semiconductor chip H1950. Note that the electrical contact (not shown) need not always be formed on the printhead H1001, and may be formed on, e.g., the carriage 2. In this case, the electrical contact of the carriage is arranged so that the electrical contact of the ink tank contacts that of the carriage when the ink tank is mounted on the printhead supported by the carriage. By detecting the contact between the electrical contacts of the carriage and ink tank, mounting of the ink tank on the printhead can be indirectly detected.

When the ink tank H1900 is mounted on the printhead H1001, the MPU of the apparatus main body reads out information from the semiconductor chip H1950, and determines whether the mounted ink tank H1900 is proper. If necessary, the MPU 601 executes a recovery operation (to be described later). When a tank of a correct type is mounted at a tank mounting position, the MPU 601 determines that the proper ink tank H1900 is mounted. When, however, a tank of a wrong type is mounted, the MPU 601 determines that no proper ink tank is mounted.

In the present embodiment, the MPU 601 of the printing apparatus main body determines the mounting state (mounting/demounting) of each ink tank H1900 on the printhead H1001 in accordance with whether information can be normally read out from the semiconductor chip H1950 of the ink tank.

<Recovery Operation performed with Mounting/Demounting of Ink Tank>

In the present embodiment, embodiments of a recovery operation executed with mounting/demounting of the ink tank H1900 will be explained. Processing shown in the flowchart of FIG. 10 to be described below is executed under the control of the MPU 601 of the apparatus main body.

First Embodiment

Figure 10:
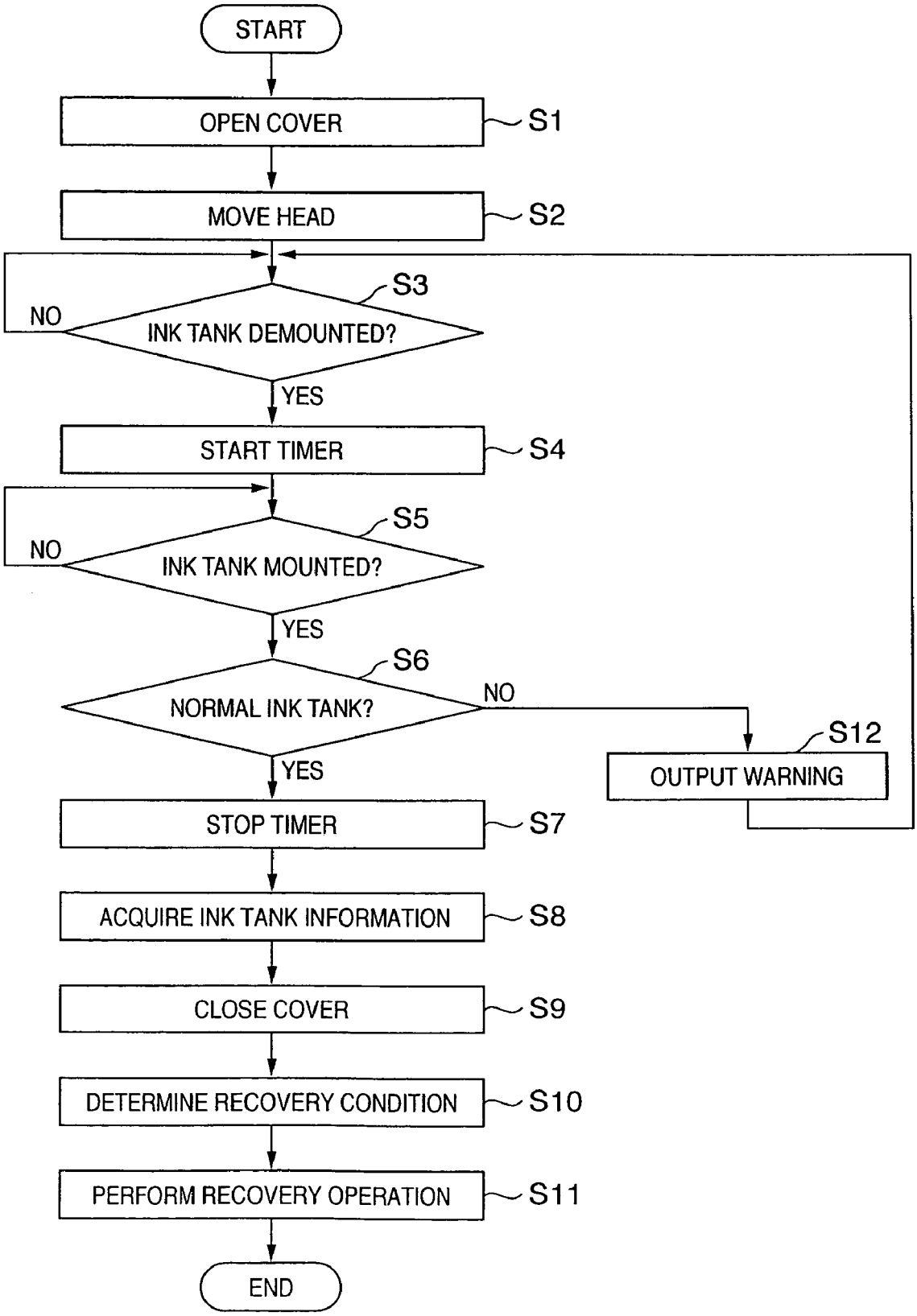
FIG. 10 is a flowchart for explaining an operation in the first embodiment.

Assume that all ink tanks H1900 are mounted as an initial state. In FIG. 10, when a user opens the cover of the inkjet printing apparatus main body in step S1, a printhead H1001 moves to a predetermined ink tank exchange position in step S2. In step S3, mounting/demounting of the ink tank H1900 is determined by the above-described method, thereby determining whether the ink tank H1900 is demounted. If the ink tank H1900 is demounted, a timer for measuring a demounting time period t of the demounted ink tank starts in step S4. The demounting time period t is measured and stored every ink tank mountable on the printhead H1001.

In the first embodiment, timers for measuring demounting time periods, and registers for storing measured demounting time periods are arranged in correspondence with five ink tanks H1900 for four, C, M, Y, and K dyes and a Bk pigment.

It is determined whether the ink tank H1900 is mounted in step S5, and it is determined whether the mounted ink tank is of a correct type in step S6. If no ink tank of a correct type is mounted, the flow advances to step S7 to output a warning to prompt the user to mount an ink tank of a correct type in step S12.

If it is detected in step S6 that an ink tank of a correct type is mounted, measurement of the demounting time period stops, and the measurement value is stored in a corresponding register in step S7. Note that if it is detected in step S6 that an ink tank of a correct type is mounted, information of the mounted ink tank H1900 is acquired in step S8. In short, in step S8, information of an ink tank which has been demounted is acquired. The information of the ink tank is information of the type of ink stored in the ink tank H1900.

After that, the flow waits until the cover of the printing apparatus is closed, the printhead H1001 moves to the home position, and the printing apparatus stands by for printing in step S9. Then, a recovery condition is determined in accordance with the demounting time period t and the information of the ink tank which are obtained in the above manner in step S10. A recovery operation is executed under the determined recovery condition in step S11.

As described above, the degrees of ink evaporation and an increase in viscosity change depending on the ink type. For example, as for dye ink and pigment ink, the pigment ink more readily coagulates and exhibits a larger increase in viscosity per unit time. Thus, the time during which no problem occurs even if the connecting portion between the ink tank H1900 and the printhead H1001 is exposed to air is shorter for pigment ink than for dye ink.

From this, the first embodiment changes the recovery condition between pigment ink and dye ink. FIGS. 6A and 6B are tables showing the correspondence between the demounting time period, the type of tank, and the recovery operation in the first embodiment. FIG. 6A shows a recovery operation corresponding to the demounting time period for C, M, Y, and K dye ink tanks H1900. FIG. 6B shows a recovery operation corresponding to the demounting time period for a black pigment ink tank H1900.

For the C, M, Y, and K dye ink tanks H1900, nothing is done if the demounting time period is 60 sec or less, as shown in FIG. 6A. If the demounting time period exceeds 60 sec, cleaning operation (I) is executed as a recovery operation. Cleaning operation (I) includes an ink sucking operation and preliminary discharge. More specifically, as the sucking operation, an ink of about 0.1 g is sucked at a suction pump speed of 500 slits/sec. As the preliminary discharge operation, ink is discharged 20 times per nozzle.

For the black pigment ink tank H1900, nothing is done if the demounting time period is 10 sec or less, as shown in FIG. 6B. If the demounting time period exceeds 10 sec, cleaning operation (II) is executed as a recovery operation. Similar to cleaning operation (I), cleaning operation (II) includes an ink sucking operation and preliminary discharge, but parameters (suction pump speed, preliminary discharge count, and the like) are different from those in cleaning operation (I). More specifically, as the sucking operation, an ink of about 0.2 g is sucked at a suction pump speed of 1,000 slits/sec. As the preliminary discharge operation, ink is discharged 40 times per nozzle.

As described above, the first embodiment executes a recovery operation appropriate for the demounting time period and ink characteristics. Even when only a specific ink readily evaporates or sticks due to its ink characteristics, a discharge failure and degradation of the printing image quality can be reduced while wasteful ink consumption is suppressed.

Second Embodiment

In the first embodiment, whether to execute a cleaning operation is controlled in two stages, but the cleaning operation is not limited to this 2-stage control. The cleaning operation executed in the first embodiment is a combination of a sucking operation and preliminary discharge operation, but these two operations need not always be combined. The second embodiment will describe a modification of the cleaning operation in the first embodiment.

FIG. 5 is a table showing the correspondence between the demounting time period of a black pigment ink tank H1900 and the recovery operation in the second embodiment. In this example, as shown in FIG. 5, four recovery operations are prepared in accordance with values of the demounting time period. More specifically, if the demounting time period is 0 sec, nothing is done. When the user mounts an ink tank, the demounting time period is not 0 sec. Hence, when an ink tank H1900 is mounted, a recovery operation is substantially executed.

When the demounting time period is longer than 0 sec and equal to or shorter than X sec, preliminary discharge is performed 20 times per nozzle as a recovery operation. When the demounting time period is longer than X sec and equal to or shorter than Y sec, a recovery sequence including suction of a 0.2-g ink at a suction pump speed of 500 slits/sec is executed as a recovery operation. Further, when the demounting time period exceeds Y sec, a recovery sequence including suction of a 0.2-g ink at a suction pump speed of 1,000 slits/sec is executed. The ink amount to be sucked is equal between a case wherein the demounting time period exceeds Y sec and a case wherein the demounting time period is longer than X sec and equal to or shorter than Y sec. However, since the suction pump speed is different, pressures applied to the nozzle, liquid chamber, and flow path of the printhead increase, and the refresh effect changes. For example, ink sticked in the nozzle can be removed more effectively at a higher suction pump speed.

As described above, the second embodiment changes the contents of the recovery operation from those in the first embodiment. Especially in the second embodiment, the recovery operation is always performed when a tank is mounted/demounted. This can further reduce a discharge failure and degradation of the printing image quality.

Third Embodiment

Similar to the first embodiment, the third embodiment employs the ink type and demounting time period as parameters for determining a recovery operation. In the third embodiment, the length and shape of an ink flow path extending to the discharge aperture of a printhead H1001, and the number of nozzles are different for the black pigment from those for the remaining inks. For this reason, the black pigment more readily clogs the ink flow path than the remaining inks.

FIGS. 7A and 7B are tables showing the correspondence between the demounting time period and the recovery operation in the third embodiment. FIG. 7A shows a recovery operation corresponding to the demounting time period for C, M, Y, and K dye ink tanks H1900. FIG. 7B shows a recovery operation corresponding to the demounting time period for a black pigment ink tank H1900.

For the C, M, Y, and K dye ink tanks H1900, the recovery operation is the same as that in the second embodiment. For the black pigment ink tank H1900, the recovery operation is executed a larger number of times than in the first embodiment. Nothing is done if the demounting time period is 0 sec. If the demounting time period exceeds 0 sec, cleaning operation (II) is executed as a recovery operation. In other words, the recovery operation is always executed when the demounted ink tank H1900 is demounted again.

In this fashion, the third embodiment considers mechanical factors (the length and shape of the ink flow path and the number of nozzles) associated with the black pigment, in addition to the demounting time period. When the pigment ink tank H1900 is mounted, a recovery operation is executed even if the demounting time period is short. As a result, even when only a specific ink readily evaporates or sticks owing to mechanical factors, a discharge failure and degradation of the printing image quality can be reduced while wasteful ink consumption is suppressed.

Fourth Embodiment

The fourth embodiment uses the amount of ink used in a demounted ink tank H1900 and that in a mounted ink tank H1900 as parameters for determining a recovery operation, in addition to the demounting time period.

In an ink tank H1900 in which a large amount of ink is used (consumed), the ink density tends to increase. The fourth embodiment reduces the presence of inks having different densities in a nozzle and ink flow path when an unused ink tank H1900 is newly mounted.

The amount of ink used is managed by counting, e.g., a discharge count on the apparatus main body side. The information may be written in a predetermined area in a semiconductor chip H1950 attached to the ink tank H1900, or written in a predetermined memory area in the apparatus main body. When the information is to be written in the semiconductor chip H1950 of the ink tank H1900, for example, bits may be written in a write-once memory area every time the use amount increases by a predetermined amount. When the information is managed on the apparatus main body side, it is preferably stored in association with the ID of the ink tank H1900.

The fourth embodiment assumes that the ink capacity of each ink tank H1900 is 12 g. When the amount of ink used in a demounted ink tank H1900 is 10 g or more and that in a mounted ink tank H1900 is 0.5 g or less, it is determined that the ink densities in the two ink tanks H1900 are different, so a suction recovery operation is executed.

FIGS. 8A and 8B are tables showing the correspondence between the demounting time period and the recovery operation in the fourth embodiment. When the amount of ink used in a demounted ink tank H1900 is 10 g or more and that in a mounted ink tank H1900 is 0.5 g or less, the operation is switched as shown in FIG. 8A. That is, if the demounting time period is 0 sec, nothing is done. If the demounting time period exceeds 0 sec, a cleaning operation is executed as a recovery operation. The cleaning operation includes an ink sucking operation and preliminary discharge.

In other cases, nothing is done if the demounting time period is 60 sec or less, as shown in FIG. 8B. If the demounting time period exceeds 60 sec, a cleaning operation is executed as a recovery operation. This cleaning operation may be the same as that executed in FIG. 8A.

In this way, according to the fourth embodiment, when the ink densities of demounted and mounted ink tanks H1900 are highly likely to be different from each other, a recovery operation is executed even if the demounting time period is short. This makes uniform the ink density in a printhead H1001 from the liquid chamber to the nozzles via the ink flow path.

Degradation of the printing image quality can be reduced while wasteful ink consumption is suppressed.

Fifth Embodiment

In a general inkjet printing apparatus, a message such as "The ink is running short. Please prepare for a new ink tank." is displayed via a printer driver or the like when the amount of ink used in an ink tank exceeds a predetermined amount. Even in this case, however, it is possible to use the current ink tank without exchanging it until ink runs out. The fifth embodiment considers a case (to be referred to as extended use) in which the current ink tank is kept used when the remaining ink amount is small.

When an ink tank is in the extended use as mentioned above, the liquid chamber or flow path in the printhead may not be sufficiently filled with ink.

To prevent this, the fifth embodiment employs information representing whether a demounted ink tank H1900 has been in the extended use, as a parameter for determining a recovery operation, in addition to the demounting time period. Note that the information of extended use may be written once in a semiconductor chip H1950 attached to the ink tank H1900, or written in a predetermined memory area in the apparatus main body.

The correspondence between the demounting time period and the recovery operation in the fifth embodiment is the same as that shown in FIGS. 8A and 8B described in the fourth embodiment. Note that when a demounted ink tank H1900 has been in the extended use, the operation is switched in accordance with FIG. 8A. In other cases, the operation is switched in accordance with FIG. 8B.

As described above, in the fifth embodiment, when a demounted ink tank H1900 has been in the extended use, a recovery operation is executed even if the demounting time period is short. Hence, the path extending from the liquid chamber to the ink flow path in the printhead H1001 is filled with ink. Degradation of the printing image quality can be reduced while wasteful ink consumption is suppressed.

Sixth Embodiment

The sixth embodiment uses the amount of ink used in a demounted ink tank and information representing whether the ID of a mounted ink tank H1900 is different, as parameters for determining a recovery operation, in addition to the demounting time period. That is, when the ID of a demounted ink tank H1900 and that of a mounted ink tank H1900 are different (i.e., the ink tank H1900 is exchanged), a recovery operation is performed even if the demounting time period is short.

In general, when demounted and mounted ink tanks H1900 have the same ID, the ink density, the ink filling state in the printhead H1001, and the like hardly change unless the demounting time period becomes long. Thus, in a case wherein the ID is kept unchanged before and after demounting/mounting, the threshold of the demounting time period by which a recovery operation is executed is set higher than that in a case wherein the ID changes.

FIGS. 9A and 9B are tables showing the correspondence between the demounting time period and the recovery operation in the sixth embodiment. When the IDs of demounted and mounted ink tanks H1900 are different from each other, the operation is switched as shown in FIG. 9A. That is, if the demounting time period is 10 sec or less, nothing is done. If the demounting time period exceeds 10 sec, a cleaning operation is executed as a recovery operation. The cleaning operation includes an ink sucking operation and preliminary discharge.

When the ID is kept unchanged before and after demounting/mounting and the demounting time period is 60 sec or less, nothing is done, as shown in FIG. 9B. If the demounting time period exceeds 60 sec, a cleaning operation is executed as a recovery operation. The cleaning operation may be the same as that executed in FIG. 9A.

In this manner, according to the sixth embodiment, when the ID of the ink tank H1900 changes before and after demounting/mounting, a recovery operation is executed even if the demounting time period is short. Considering whether the ink tank H1900 is substantially exchanged, degradation of the printing image quality can be reduced while wasteful ink consumption is suppressed.

Other Embodiment

Information of the ink tank H1900 other than the parameters exemplified in the above embodiments may be used as a parameter for determining a recovery operation. Alternatively, some of the exemplified parameters may be used as parameters for determining a recovery operation.

In the embodiment of a cleaning operation executed upon mounting of the ink tank H1900, two parameters are referred to at maximum. However, three or more parameters are used to determine a recovery operation to be executed. In this case, the operation may be switched by the first parameter, and a recovery operation to be executed may be determined using a table corresponding to a combination of the two remaining parameters. Alternatively, a recovery operation may be determined by a predetermined conditional expression considering the influence of each parameter.

In the above embodiments, information of the type and ID of an ink tank is electrically stored in a semiconductor chip (memory) attached to the ink tank. However, the information of the type and ID of an ink tank may be held by another method. In this case, the information of the type and ID of an ink tank may be held in a read-only form. For example, a mark such as a barcode is added to an ink tank, and the printhead or apparatus is equipped with optical reading means. Note that a form is preferable in which information of the amount of ink used and extended use can be written once, as described above.

In addition, in the above embodiments, the mounting state of an ink tank is detected in accordance with whether information in the semiconductor chip attached to the ink tank can be read out. However, the mounting state of an ink tank may be detected by another method. For example, a contact which contacts an ink tank when the ink tank is normally mounted is arranged to detect the mounting state of the ink tank.

Further, the above embodiments have exemplified an inkjet printing apparatus which discharges ink by thermal energy. However, the present invention can also be applied to a printing apparatus which discharges ink or liquid by another method. Also, the printing method of the printing apparatus is not limited to serial printing described in the above embodiments. The composition and type (number of ink tanks) of ink used for printing are not particularly limited, and the present invention can be applied to printing apparatuses of various configurations.

The present invention may be applied to a printing system including a plurality of devices or a printing apparatus formed by a single device.

Note that the present invention may be achieved by supplying a software program for implementing the functions of the above-described embodiments to a system or apparatus directly or from a remote place, and reading out and executing the program by the computer of the system or apparatus. In the embodiments, programs corresponding to the cases shown in FIGS. 5 to 9B are supplied. In this case, the form is not always the program as far as program functions are provided.

The present invention is therefore implemented by program codes installed in the computer in order to implement functional processing of the present invention by the computer. That is, claims of the present invention include a computer program for implementing functional processing of the present invention.

In this case, the program form is arbitrary, such as an object code, a program executed by an interpreter, or script data supplied to an OS as long as a program function is attained.

As many apparently widely different embodiments of the present invention can be made without departing from the spirit and scope thereof, it is to be understood that the invention is not limited to the specific embodiments thereof except as defined in the appended claims.

This application claims the benefit of Japanese Patent Application No. 2005-200651, filed on Jul. 8, 2005, which is hereby incorporated by reference herein in its entirety.

What is claimed is:

1. An inkjet printing apparatus which performs printing using a printhead for discharging ink and an ink tank for supplying ink to the printhead, the ink tank being detachably attachable to the printhead, comprising:

a recovery unit adapted to execute a recovery operation for discharging ink from the printhead;

a measurement unit adapted to measure a time period between when an ink tank previously attached to the printhead is detached from the printhead and when an ink tank is subsequently attached to the printhead;

a determination unit adapted to determine whether or not the ink tank subsequently attached to the printhead is the same as the ink tank detached from the printhead;

a control unit adapted to control the recovery unit based on the time period measured by the measurement unit and the result determined by the determination unit;

wherein, if the determination unit determines that the ink tank subsequently attached to the printhead is the same as the ink tank detached from the printhead, the control unit controls the recovery unit to execute the recovery operation in cases where the time period is longer than a first time period, and the control unit controls the recovery unit not to execute the recovery operation in cases where the time period is shorter or equal to the first time period, and if the determination unit determines that the ink tank subsequently attached to the printhead is different from the ink tank detached from the printhead, the control unit controls the recovery unit to execute the recovery operation regardless of the time period.

2. The apparatus according to claim 1, wherein the recovery operation includes at least one of preliminary discharge to discharge ink from the printhead irrespective of printing, and a sucking operation to forcibly discharge ink from the printhead.

3. An inkjet printing apparatus which performs printing by scanning a carriage adapted to mount a printhead for discharging ink, and an ink tank for supplying ink to the printhead, the ink tank being detachably mountable to the carriage, comprising:

a recovery unit adapted to execute a recovery operation for discharging ink from the printhead mounted on the carriage;

a measurement unit adapted to measure a time period between when an ink tank previously mounted on the carriage is demounted from the carriage and when an ink tank is subsequently mounted on the carriage;

a determination unit adapted to determine whether or not the ink tank subsequently mounted on the carriage is the same as an ink tank that was demounted from the carriage; and a control unit adapted to control the recovery unit based on the time period measured by the measurement unit and the result determined by the determination unit, wherein, if the ink tank subsequently mounted on the carriage is the same as the ink tank demounted from the carriage, the control unit controls the recovery unit to execute the recovery operation in cases where the time period is longer than a first time period, and the control unit controls the recovery unit not to execute the recovery operation in cases where the time period is shorter or equal to the first time period, and if the ink tank subsequently mounted on the carriage is different from the ink tank demounted from the carriage, the control unit controls the recovery unit to execute the recovery operation regardless of the time period.

4. An inkjet printing apparatus which performs printing by scanning a carriage adapted to mount a printhead for discharging ink and an ink tank for supplying the ink to the printhead, the ink tank being detachably mountable to the carriage, comprising:

a recovery unit adapted to execute a recovery operation for discharging ink from the printhead mounted on the carriage;

a detection unit adapted to detect when an ink tank is demounted from the carriage and when an ink tank is mounted on the carriage;

a measurement unit adapted to measure a time period from detection of demounting an ink tank from the carriage to detection of mounting an ink tank to the carriage;

a determination unit adapted to determine whether or not the ink tank detected to be mounted on the carriage is the same as the ink tank that was detected as being demounted; and a control unit adapted to control the recovery unit based on the time period measured by the measurement unit and the result determined by the determination unit, wherein, if the ink tank that is detected as being mounted is the same as the ink tank that was detected as being demounted, the control unit controls the recovery unit to execute the recovery operation in cases where the time period is longer than a first time period, and the control unit controls the recovery unit not to execute the recovery operation in cases where the time period is shorter or equal to the first time period, and if the ink tank detected as being mounted is different from the ink tank that was detected as being demounted, the control unit controls the recovery unit to execute the recovery operation regardless of the time period.

* * * * *